US007337849B2

(12) United States Patent
Williams

(10) Patent No.: US 7,337,849 B2
(45) Date of Patent: Mar. 4, 2008

(54) CO-LINEAR TENSIONER AND METHODS OF INSTALLING AND REMOVING SAME

(75) Inventor: Richard D. Williams, Sugar Land, TX (US)

(73) Assignee: Control Flow Inc., Houston, TX (US)

( * ) Notice: Subject to any disclaimer, the term of this patent is extended or adjusted under 35 U.S.C. 154(b) by 0 days.

(21) Appl. No.: 11/487,270

(22) Filed: Jul. 14, 2006

(65) Prior Publication Data

US 2006/0254776 A1 Nov. 16, 2006

Related U.S. Application Data

(63) Continuation of application No. 11/060,660, filed on Feb. 17, 2005.

(51) Int. Cl.
*E21B 29/12* (2006.01)

(52) U.S. Cl. ..... 166/355; 166/359; 166/367

(58) Field of Classification Search ..... 166/355, 166/346, 367, 359; 405/224.2, 224.4
See application file for complete search history.

(56) References Cited

U.S. PATENT DOCUMENTS 4,808,035 A * 2/1989 Stanton et al. ..... 405/224.4
5,658,095 A * 8/1997 Arlt et al. ..... 405/195.1
5,846,028 A * 12/1998 Thory ..... 405/195.1
6,554,072 B1 * 4/2003 Mournian et al. ..... 166/355
6,585,455 B1 * 7/2003 Petersen et al. ..... 405/224.4
2005/0074296 A1 * 4/2005 McCarty et al. ..... 405/224.4
2006/0016605 A1 * 1/2006 Coles ..... 166/355
2006/0151176 A1 * 7/2006 Moe ..... 166/355

* cited by examiner

*Primary Examiner*—Thomas A Beach
(74) *Attorney, Agent, or Firm*—Greenberg Traurig LLP; Anthony F. Matheny

(57) ABSTRACT

The invention is directed to a tensioner for providing linear and angular movement of a drilling or production facility relative to a conduit or riser secured to the tensioner and to the wellhead in offshore operations. The tensioner compensates for vessel motion induced by wave action and heave and maintains a variable tension to the riser string alleviating the potential for compression and thus buckling or failure of the riser string. The tensioner of the present invention preferably includes at least one top load plate that facilitates easy and quick installation and removal of the tensioner from the rig floor of the vessel or platform. The tensioner also facilitates the placement of at least one piece of equipment disposed within the area formed by the tensioning cylinders. The tensioner may also include one or more pieces of equipment, e.g., a rotary table, integrally formed with the tensioner to further increase the ease and speed of installation and removal of the tensioner from the rig floor. Methods for installing and removing tensioners from the rig floor are also disclosed.

25 Claims, 6 Drawing Sheets

CO-LINEAR TENSIONER AND METHODS OF INSTALLING AND REMOVING SAME

RELATED APPLICATION

This application is a continuation of, and claims the benefit of, U.S. application Ser. No. 11/060,660, filed Feb. 17, 2005, and which is currently pending.

BACKGROUND OF THE INVENTION

1. Field of the Invention

The invention relates to offshore drilling and production operations and is specifically directed to drilling and production tensioners and methods for installing and removing drilling and production tensioners.

2. Description of Related Art

A marine riser system is employed to provide a conduit from a floating vessel at the water surface to the blowout preventer stack or, production tree, which is connected to the wellhead at the sea floor. A tensioning system is utilized to maintain a variable tension to the riser string alleviating the potential for compression and in turn buckling or failure.

Historically, conventional riser tensioner systems have consisted of both single and dual cylinder assemblies with a fixed cable sheave at one end of the cylinder and a movable cable sheave attached to the rod end of the cylinder. The assembly is then mounted in a position on the vessel to allow convenient routing of wire rope which is connected to a point at the fixed end and strung over the movable sheaves. A hydro/pneumatic system consisting of high pressure air over hydraulic fluid applied to the cylinder forces the rod and in turn the rod end sheave to stroke out thereby tensioning the wire rope and in turn the riser.

Other prior tensioners require superstructure that restricts to the top or the bottom of the tensioner the location of workover equipment and other devices that are placed in-line with the drilling or production string. These conventional type tensioning systems have required high maintenance during normal operations due to the constant motion producing wear and degradation of the wire rope members. Replacing the active working sections of the wire rope by slipping and cutting raises safety concerns for personnel and has not proven cost effective. In addition, available space for installation and, the structure necessary to support the units including weight and loads imposed, particularly in deep water applications where the tension necessary requires additional tensioners poses difficult problems for system configurations for both new vessel designs and upgrading existing vessel designs.

Other problems unaddressed by these prior tensioners include the location of workover and other equipment placed in-line with the production or drill string and the high cost, labor, and increased safety concerns posed with the installation and removal of these tensioners.

The tensioner system of the present invention is an improvement over existing conventional and direct acting tensioning systems. Beyond the normal operational application to provide a means to apply variable tension to the riser, the system provides a number of enhancements and options including vessel configuration and its operational criteria. The tensioners of the invention may include additional equipment or components to facilitate quick and efficient installation and removal of the additional equipment along with the tensioner. For example, workover equipment such as workover units and snubbing units, may be disposed within the area formed by the tensioning cylinders. Additionally, a rotary table may be formed as part of the tensioner such that instead of removing the rotary table, inserting the tensioner, and replacing the rotary table, the tensioner can be installed with the rotary table already secured to the tensioner. Because of this novel design, the rotary table beams which support the rotary table may be moved to create a larger opening for larger tensioners. The larger opening also provides flexibility in the location of the tensioning cylinders to facilitate placement of other equipment, e.g., workover equipment.

Therefore, the tensioner and the methods of the present invention provide the advantages of: providing relatively quicker and safer installation of tensioners and other equipment; providing flexibility in location of equipment in fluid communication with the tensioners; eliminating offset and the resulting unequal loading in the event one or more of the tensioning cylinders fail; providing a system that is modular in construction, transportation, and assembly; providing interchangeability with other drilling or production facilities; reducing the amount of time that the wellhead is "idle," i.e., that either a drilling riser or production riser is out of use by facilitating quick and easy installation of the tensioner, rotary table, and workover equipment; providing sufficient tension to the long string of the riser in deepwater over extended periods of time; providing a means to maintain the riser in constant tension, with, if necessary, overpull, while the riser is in service; providing the capability to accommodate angular offset between the riser and the vessel induced by vessel motion; and providing the capability to accommodate axial torque induced in the riser string in the event the drilling or production vessel rotates around the wellhead due to weather and sea conditions.

SUMMARY OF INVENTION

The foregoing advantages have been obtained through the present tensioner comprising: at least one top load plate; at least one upper swivel member in communication with the at least one top load plate; at least one cylinder plate in communication with the at least one upper swivel member; at least one tensioning cylinder having a blind end and a rod end, the blind end being in communication with the at least one cylinder plate and the rod end being in communication with at least one rod end swivel member; and a base in communication with the at least one rod end swivel member, thereby forming a unitary, co-linear tensioner.

A further feature of the tensioner is that the tensioner may further comprise at least one piece of equipment being in communication with the top load plate. Another feature of the tensioner is that the at least one piece of equipment may be a rotary table. An additional feature of the tensioner is that the rotary table may be formed integral with the top load plate. Still another feature of the tensioner is that the tensioner may include at least two tensioning cylinders disposed along a tensioning cylinder plate thereby forming an area in between the at least two tensioning cylinders and may further comprise at least one piece of equipment being disposed within the area formed in between the at least two tensioning cylinders. A further feature of the tensioner is that the tensioner may further comprise at least one equipment guide rail and wherein the at least one piece of equipment includes at least one guide slidably engaged with the at least one equipment guide rail. Another feature of the tensioner is that the piece of equipment may be at least one snubbing unit. An additional feature of the tensioner is that the piece of equipment may be at least one blowout preventer. Still another feature of the tensioner is that the at least one piece of equipment may include at least one equipment guide rail and the tensioner further comprising at least one guide slidably engaged with the at least one equipment guide rail. A further feature of the tensioner is that the piece of equipment may be at least one snubbing unit. Another feature of the tensioner is that the piece of equipment maybe at least one blowout preventer. An additional feature of the tensioner is that the tensioner may further comprise at least one extension rod and at least one extension platform in communication with the base. Still another feature of the tensioner is that at least one piece of equipment may be disposed on the extension platform. A further feature of the tensioner is that the at least one piece of equipment may include at least one blowout preventer. Another feature of the tensioner is that each of the at least one tensioning cylinders may include a tensioning cylinder casing having a length and at least one fluid control port. An additional feature of the tensioner is that each of the at least one fluid control ports may be disposed along the length of each of the tensioning cylinders. Still another feature of the tensioner is that the tensioner may further comprise at least one lower swivel member in communication with the base.

The foregoing advantages also have been obtained through the present tensioner comprising: at least one top load plate, at least one upper swivel assembly, at least one tensioning cylinder plate, at least one tensioning cylinder, and a base, the at least one tensioning cylinder being in communication with the at least one tensioning cylinder plate and with the base, wherein the at least one top load plate, the at least one upper swivel assembly, the at least one tensioning cylinder plate, the at least one tensioning cylinder, and the base are assembled to form a unitary, co-linear tensioner.

A further feature of the tensioner is that the tensioner may further comprise at least one lower swivel assembly. Another feature of the tensioner is that the tensioner may include at least four tensioning cylinders disposed along a tensioning cylinder plate. An additional feature of the tensioner is that the at least four tensioning cylinders may form an area in between the at least four tensioning cylinders and may further comprise at least one piece of equipment being disposed within the area formed in between the at least four tensioning cylinders. Still another feature of the tensioner is that a rotary table may be formed integral with top load plate.

The foregoing advantages also have been obtained through the present method of installing at least one tensioner through a wellhead opening defining an open area size disposed along a rig floor of a drilling or production vessel or platform, the method comprising the steps of: providing a drilling or production vessel or platform having a rig floor, the rig floor having a wellhead opening, the wellhead opening defining an open area through which the at least one tensioner is passed; providing at least one tensioner having at least one top load plate, at least one upper swivel assembly, at least one tensioning cylinder plate, at least one tensioning cylinder, and a base, the at least one tensioning cylinder being in communication with the at least one tensioning cylinder plate and with the base, wherein the at least one top load plate, the at least one upper swivel assembly, the at least one tensioning cylinder plate, the at least one tensioning cylinder, and the base are assembled to form a unitary, co-linear tensioner; lowering the at least one tensioner through the open area of the wellhead opening of the rig floor; installing the at least one tensioner by contacting the top load plate with the rig floor whereby the rig floor supports the at least one tensioner.

A further feature of the method is that the rig floor may include at least one moveable rotary table beam and the method may include the further step of moving the at least one moveable rotary table beam to increase the open area of the wellhead opening prior to lowering the at least one tensioner through the open area of the wellhead opening of the rig floor.

The tensioners and the methods of the present invention, when compared with previous tensioners and methods, have the advantages of: providing relatively quicker and safer installation of tensioners and other equipment; providing flexibility in location of equipment in fluid communication with the tensioners; eliminating offset and the resulting unequal loading in the event one or more of the tensioning cylinders fail; providing a system that is modular in construction, transportation, and assembly; providing interchangeability with other drilling or production facilities; reducing the amount of time that the wellhead is "idle," i.e., that either a drilling riser or production riser is in use by facilitating quick and easy installation of the tensioner, rotary table, and workover equipment; providing sufficient tension to the long string of the riser in deepwater over extended periods of time; providing a means to maintain the riser in constant tension, with, if necessary, overpull, while the riser is in service; providing the capability to accommodate angular offset between the riser and the vessel induced by vessel motion; and providing the capability to accommodate axial torque induced in the riser string in the event the drilling or production vessel rotates around the wellhead due to weather and sea conditions.

While the invention will be described in connection with the preferred embodiment, it will be understood that it is not intended to limit the invention to that embodiment. On the contrary, it is intended to cover all alternatives, modifications, and equivalents, as may be included within the spirit and scope of the invention as defined by the appended claims.

DESCRIPTION OF SPECIFIC EMBODIMENTS

In one aspect, the invention comprises elements that when assembled form a unitary co-linear tensioner. The tensioner may be used to replace both conventional and direct acting tensioning systems. Further, variations of the tensioner may be utilized in both drilling and production riser applications.

Figure 1:
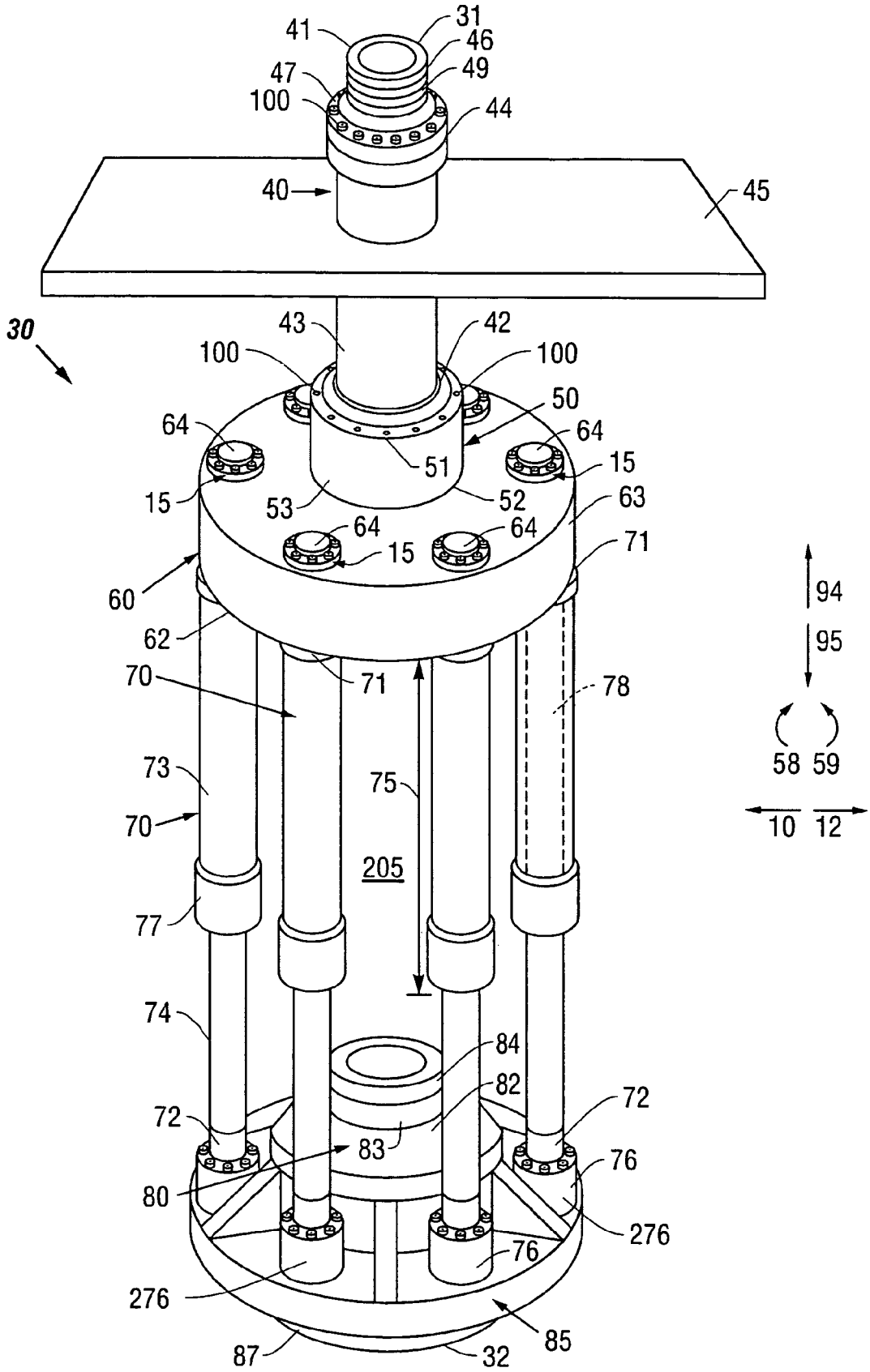
FIG. 1 is a perspective view of one specific embodiment of the tensioner of the present invention.
Figure 2:
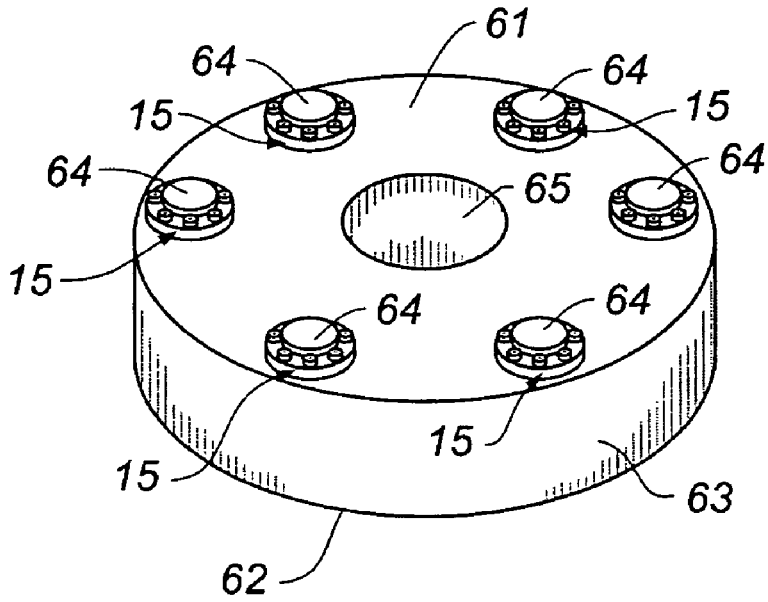
FIG. 2 is a cross-sectional top view of the tensioner assembly plate of the tensioner shown in FIG. 1 taken along line 2-2.
Figure 4:
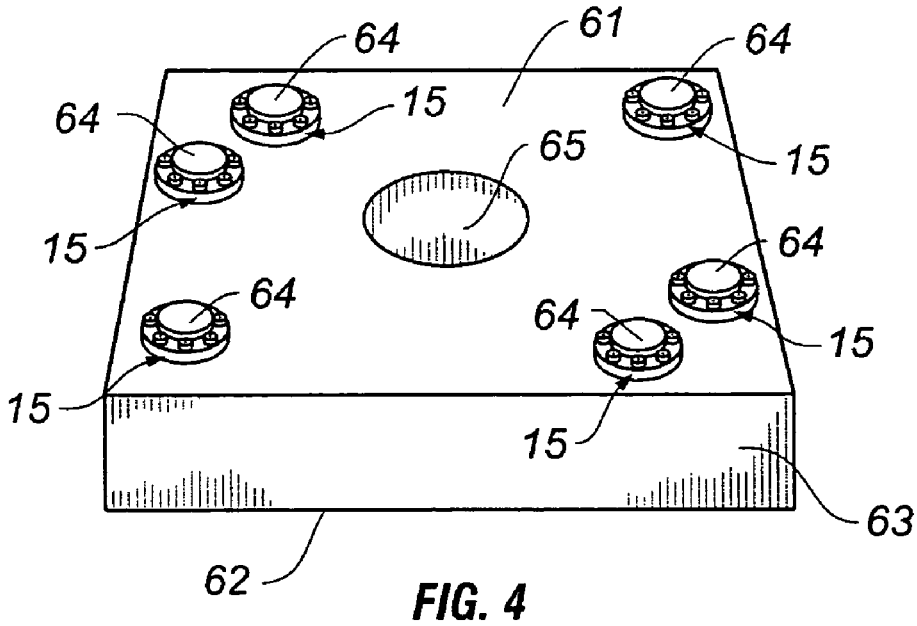
FIG. 4 is a cross-sectional top view of the tensioner assembly plate of the tensioner shown in FIG. 1 taken along line 4-4.
Figure 3:
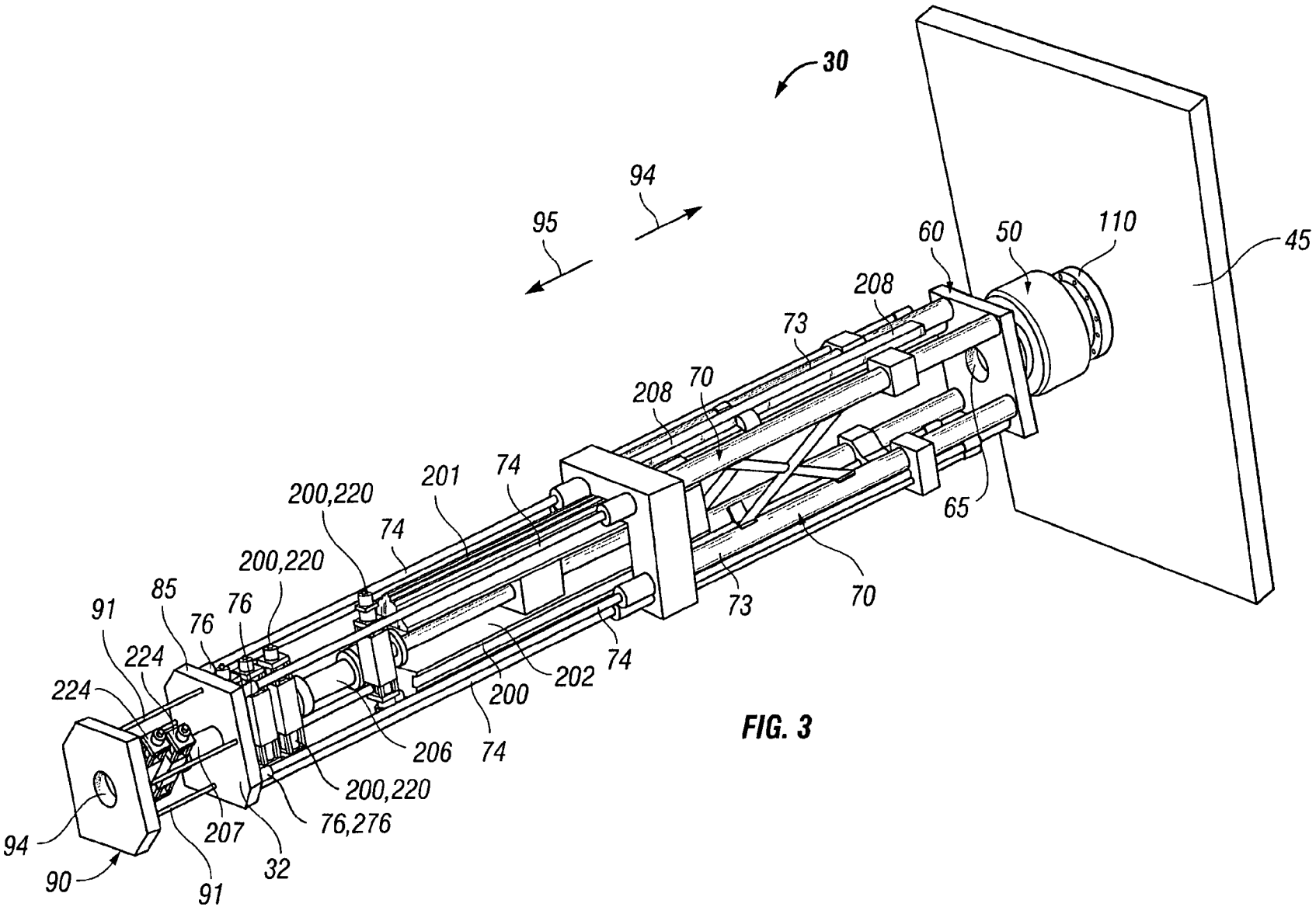
FIG. 3 is a perspective view of another specific embodiment of the tensioner of the present invention.
Figure 5:
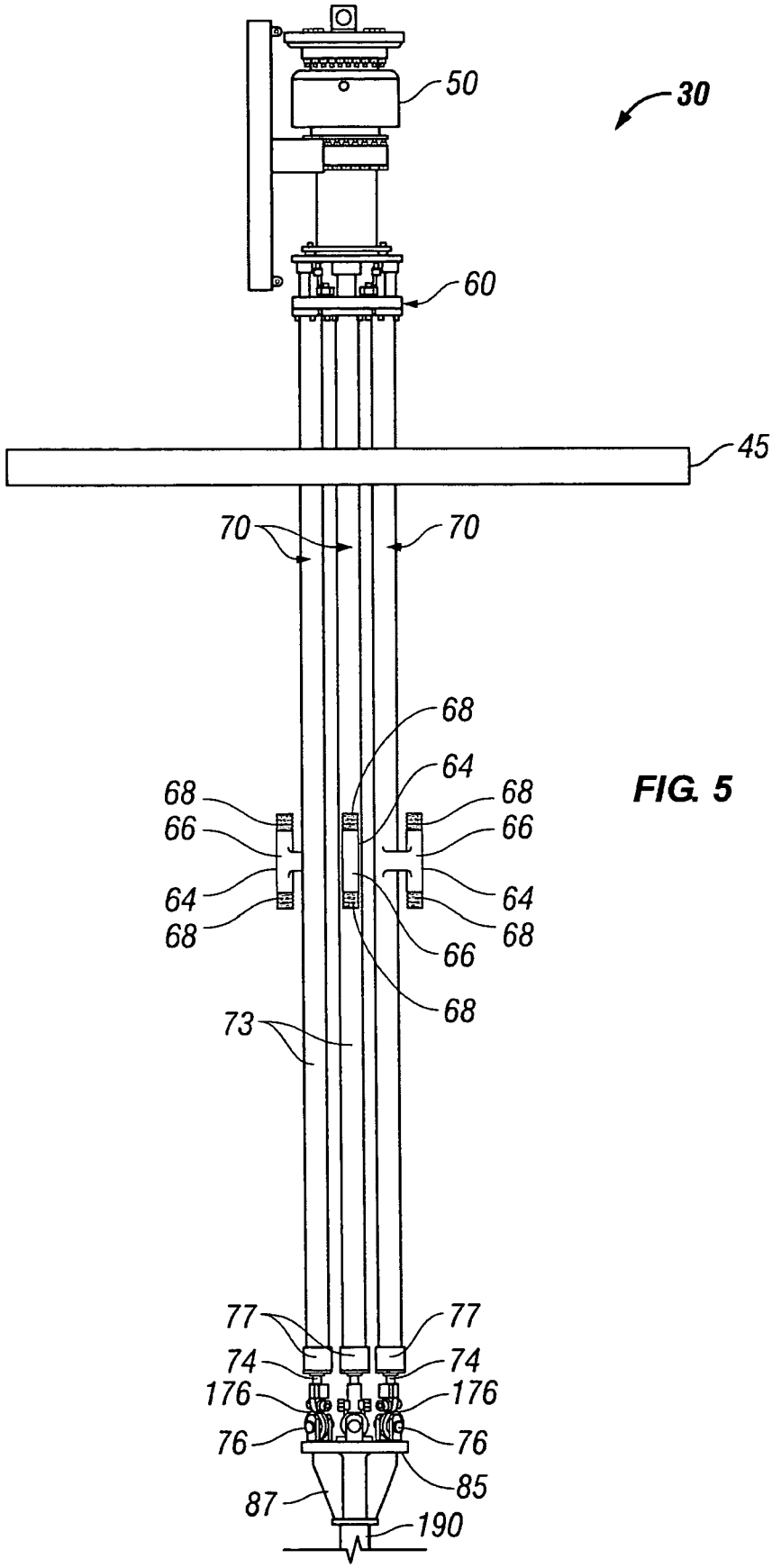
FIG. 5 is a side view of another specific embodiment of the tensioner of the present invention.

Referring now to FIGS. 1-4, broadly, the present invention is directed to tensioner 30 having first tensioner end 31, second tensioner end 32, a retracted position (as illustrated in FIG. 5), and at least one extended position (e.g., as illustrated in FIG. 3). Preferably, tensioner 30 includes the following sub-assemblies: at least one mandrel, or spool, 40 having at least one top load plate 45; at least one upper swivel assembly 50 (which may be a ball-joint, a flex-joint, or a bearing assembly, all of which are known in the art); at least one tensioning cylinder, or cylinder, 70; and at least one base 85. Base 85 facilitates connecting second end 32 of tensioner 30 to other subset appliances or equipment, e.g, blowout preventer stacks, production trees, manifolds, and riser components, e.g., tubulars of the riser string. In a preferred embodiment (shown in FIG. 3), base 85 is secured to extension platform 90 by rigid extension rods 91 to facilitate placement of additional equipment 200 such as blowout preventers 220 and spacer 206. Extension platform 90 also includes opening 94 which is adapted to facilitate connection to the riser or additional components or equipment of the riser string, e.g., flange/connectors such as latch dog profile as discussed in greater detail below regarding mandrel 40, locking rings, load rings, or casing slips.

Either base 85 of tensioner 30 or extension platform 90 is releasably secured to the riser or other riser component or equipment through any method or device known to persons skilled in the art, e.g., latch dogs, a locking ring, a load ring, or casing slips disposed around the tubular. Preferably, riser connector member 87 (FIG. 1) is included on base 85 and is powered, either pneumatically or hydraulically to facilitate remotely securing and releasing the tubular or other riser component.

Upper swivel assembly 50 and, in some specific embodiments, at least one lower swivel assembly 80 is included to compensate for vessel offset i.e., vessel position in relationship to the well bore center and riser angle. As with upper swivel assembly 50, lower swivel assembly 80 maybe a ball-joint, a flex-joint, or a bearing assembly, all of which are known in the art.

As illustrated in FIG. 1, mandrel 40 includes first mandrel end 41, second mandrel end 42, mandrel body 43, and at least one top load plate 45. Top load plate 45 facilitates connection of tensioner 30 to the superstructure of the drilling or production vessel or platform by providing a portion of top load plate 45 to be disposed on the superstructure so that tensioner 30 is supported by top load plate resting on the superstructure. Top load plate 45 may be any shape or size desired or necessary to support tensioner 30 on the superstructure of the drilling or production vessel or platform. As shown in FIGS. 1, 3, 5 and 7, top load plate 45 is rectangularly shaped.

Mandrel 40 may be connected to a diverter assembly or other piece of equipment (not shown), through an interface mandrel 46 having a mandrel lower connection flange 47 which may be connected to hang-offjoint 44 through any method known to persons of ordinary skill in the art. As shown in FIG. 1, mandrel lower connection flange 47 is connected to hang-offjoint 44 through the use of bolts 100.

Figure 6:
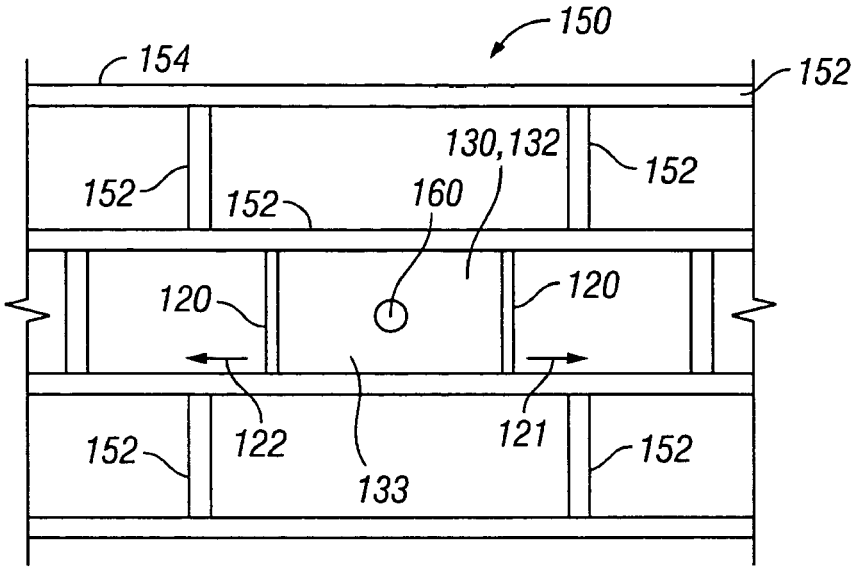
FIG. 6 is a top view of a production platform centered on a wellhead.
Figure 7:
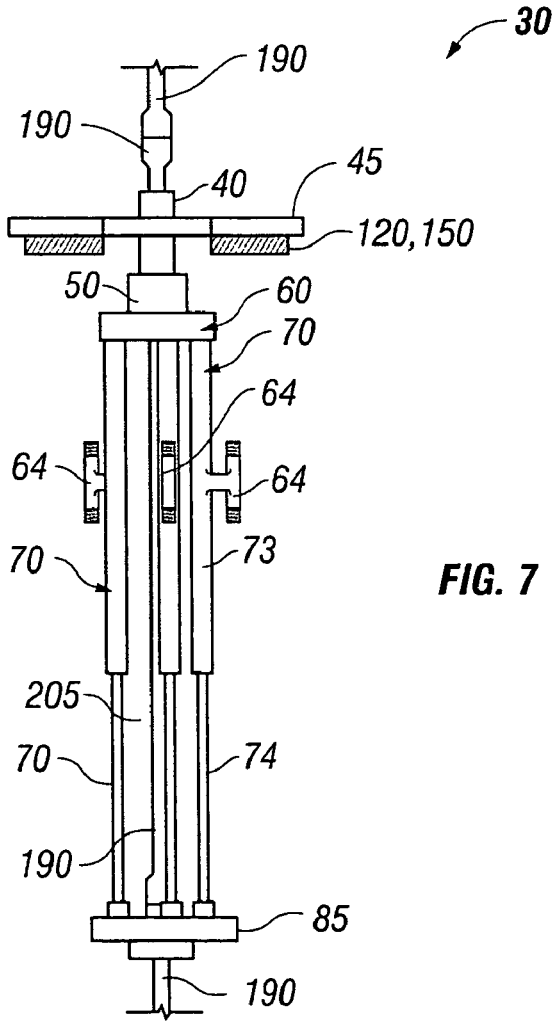
FIG. 7 is a side view of one specific tensioner of the present invention installed on the rotary beams of a production platform.

In one specific embodiment of the invention, top load plate 45 may be formed as part of a rotary table 110 (FIG. 3) or other equipment and secured directly to upper swivel assembly 50. Top load plate 45 contacts the superstructure of the production or drilling platform of a tension leg platform, drilling vessel, production vessel or any other superstructure from which drilling and production operations are staged so that tensioner 30 is generally supported under the superstructure of the vessel or platform. As shown in FIGS. 6-7, tensioner 30 is disposed on top of rotary table beams 120. This allows for the complete tensioner 30, including the riser, blow-out preventer stack, workover equipment, or any other riser string component or equipment to be installed by dropping the tensioner assembly 30 through wellhead opening 130 of vessel or platform 150 and removing the entire tensioner assembly 30 by lifting tensioner assembly out of wellhead opening 130. Vessel or platform 150 includes support beams 152 (FIG. 6).

Top load plate 45 maybe integral to upper swivel assembly 50. Alternatively, top load plate 45 may be disposed along the tensioning cylinders 70, thereby capturing tensioning cylinders 70 so that top load plate 45 is disposed more centrally to the overall length of tensioner 30 (see FIG. 5). In this position, top load plate permits transference of axial tension load from cylinder casing 73 of tensioning cylinder 70 to mandrel 40 and then directly to the platform or vessel superstructure shown in FIG. 6.

Second mandrel end 42 is in communication with upper swivel assembly 50. Upper swivel assembly 50 includes first upper swivel end 51, second upper swivel end 52, and housing 53 having at least one swivel member, e.g., ball-joint, flexjoint, bearings, shackles, which may be disposed within housing 53. Swivel members of upper swivel assembly 50 permit rotational movement of tensioning cylinders 70, and lower swivel assembly 80 in the direction of arrows 58, 59 and arrows 10, 12. This arrangement allows for mandrel 40 to be locked into a connector (not shown) or vessel or platform 150 (FIG. 6) supported under the vessel or platform 150 which maintains the upper swivel assembly 50 and riser tubulars 190 (FIG. 7) in a locked, static position, while allowing tensioning cylinder 70 and lower swivel assembly 80 to swivel in the direction of arrows 58, 59 and arrows 10, 12. Upper swivel assembly 50 provides angular movement of approximately 15 degrees over 360 degrees compensating for riser angle and vessel offset. Upper swivel assembly 50 may be any shape or size desired or necessary to permit movement of tensioning cylinder 70 and lower swivel assembly 80 to a maximum of 15 degrees angular movement in any direction over 360 degrees. As shown in FIG. 1, upper swivel assembly 50 is cylindrically shaped.

Still with reference to FIG. 1, second upper swivel assembly end 52 is in communication with tensioning cylinder plate 60 through any method or device known to persons of ordinary skill in the art, e.g., mechanical connector, or bolts 100. In one embodiment, upper swivel assembly 50 is integral with tensioner 30. Upper swivel assembly 50 permits tensioning cylinder plate 60, and thus, the mounted tensioning cylinders 70, to move in the direction of arrows 58, 59 and arrows 10, 12 when in tension thereby minimizing the potential to induce axial torque and imposing bending forces on the mounted tensioning cylinders 70.

As illustrated in detail in FIGS. 2 and 4 tensioning cylinder plate 60 includes top surface 61, bottom surface 62, body 63, and opening 65. Top surface 61 of tensioning cylinder plate 60 preferably includes at least one cylinder attachment plate 15 for securing each of the tensioning cylinders 70 to the tensioning cylinder plate 60. In specific embodiments shown in FIGS. 1 and 3, cylinder attachment plate 15 include control interface 64 which are in communication with one or more of the at least one tensioner cylinder 70 and at least one control source (not shown), e.g., through the use of gooseneck hose assemblies known to persons of ordinary skill in the art. Examples of suitable control sources include, but are not limited to, atmospheric pressure, accumulators, air pressure vessels (A.P.V.), and hoses for connecting the gooseneck hose assembly to the accumulator and air pressure vessel. Alternatively, control interfaces 64 are disposed along the length of each tensioning cylinders 70 as shown in FIG. 5.

Control interface 64 permits pressure, e.g., pneumatic and/or hydraulic pressure, to be exerted from the control source, through control interface 64 into tensioning cylinder 70 to provide tension to tensioner 30 as discussed in greater detail below and to move tensioner 30 from the retracted position to the extended position and vice versa. It is to be understood that only one control interface 64 may be used in connection with a manifold (not shown) wherein the manifold places each tensioning cylinder 70 in fluid communication with each other. Alternatively, a separate control interface 64 may be included with each tensioning cylinder 70.

While tensioning cylinder plate 60 may be fabricated or machined in any shape, out of any material, and through any method known to persons of ordinary skill in the art, preferably top load plate is machined in a rectangular or square configuration, out of stainless steel.

As illustrated in FIG. 1, each tensioner cylinder 70 preferably includes blind end 71, rod end 72, cylinder casing 73 having length 75, rod 74, cylinder head 77, and cylinder cavity 78. While cylinder casing 73 may be formed out of any material known to persons of ordinary skill in the art, cylinder casing 73 is preferably formed out of carbon steel, stainless steel, titanium, or aluminum. Further, cylinder casing 73 may include a liner (not shown) inside cylinder casing 73 that contacts rod 74.

Control interface 64 (FIGS. 1, 2, 4, 5, and 7) is in fluid communication with cylinder cavity 78 thereby permitting fluid to be injected into or withdrawn out of cylinder cavity 78 to facilitate movement of rod 74 into and out of cylinder casing 73.

Each tensioning cylinder 70 may be disposed along tensioning cylinder plate 60 in any configuration desired or necessary to provide sufficient space within area 150 formed by the tensioning cylinders such that equipment or tubulars can be disposed within area 150.

Each tensioner cylinder 70 permits vertical movement of tensioner 30 from, and to, the retracted position, i.e., each rod 74 is moved into the respective cylinder casing 73. Each tensioner cylinder 70 also permits vertical movement of tensioner 30 from, and to, the extended position, i.e., each rod 74 is moved from within the respective cylinder casing 73. It is noted that tensioner 30 includes numerous retracted positions and extended positions and these terms are used merely to describe the direction of movement. For example, movement from the retracted position to the extended positions means that rod 74 is being moved from within the respective cylinder casing 73 and movement from the extended position to the retracted position means that rod 74 is being moved into the respective cylinder casing 73. The use of the term "fully" preceding extended and retracted is to be understood as the point in which rod 74 can no longer be moved from within cylinder casing 73 ("fully extended"), and the point in which rod 74 can no longer be moved into cylinder casing 73 ("fully retracted").

Tensioner 30 may be moved from the retracted position to the extended position, and vice versa, using any method or device known to persons skilled in the art. For example, tensioner 30 may be moved from the retracted position to the extended position by gravity. Alternatively, at least one control source in communication with tensioner 30 as discussed above to facilitate movement of tensioner 30 from the extended position to the retracted position and vice versa may be used.

In the specific embodiment shown in FIGS. 1 and 3, each cylinder rod end 72 includes at least one swivel member 76, such as shackles 176 (FIG. 3) or ball-joints or flex-joints 276 (FIGS. 1 and 3). Each swivel member 76 permits rotational movement of each tensioning cylinder 70 in the direction of arrows 58, 59 and arrows 10, 12 in the same manner as discussed above with respect to upper swivel assembly 50 and lower swivel assembly 80. As shown in FIG. 1, each swivel member 76 is in communication with base 85, and each blind end 71 is in communication with bottom surface 62 of tensioning cylinder plate 60. Alternatively, each swivel member 76 may be in communication with lower swivel assembly 80. Swivel member 76 preferably has a range of angular motion of +/−15 degrees for alleviating the potential to induce torque and/or bending forces on cylinder rod 74.

As shown in FIGS. 1, 2 and 4, blind ends 71 are drilled with a bolt pattern to allow bolting in a compact arrangement on bottom surface 62 of tensioning cylinder plate 60. Preferably, a plurality of appropriately sized tensioning cylinders 70 equally, and symmetrically, spaced around tensioning cylinder plate 60 are employed to produce the tension required for the specific application. Tensioning cylinders 70 are preferably disposed with rod end 72 down, i.e., rod end 72 is closer to base 85, or lower swivel member 80, than to tensioning cylinder plate 60. It is to be understood, however, that one, or all, tensioning cylinders 70 may be disposed with rod end 72 up, i.e., rod end 72 is closer to tensioning cylinder 60.

Each tensioning cylinder 70 is designed to interface with at least one control source, e.g., air pressure vessels and accumulators via control interface 64 of cylinder attachment plate 15 (FIGS. 1-4) or through control interface 64 having transfer piping 66 with hose attachment members 68 (FIGS. 5 and 7).

While it is to be understood that tensioning cylinder 70 may be formed out of any material known to persons of ordinary skill in the art, preferably, tensioning cylinder 70 is manufactured from a light weight material that helps to reduce the overall weight of the tensioner 30, helps to eliminate friction and metal contact within the tensioning cylinder 70, and helps reduce the potential for electrolysis and galvanic action causing corrosion. Examples include, but are not limited to, carbon steel, stainless steel, aluminum and titanium.

As discussed above, and shown in FIG. 1, in one specific embodiment, lower swivel assembly 80 is in communication with base 85. Lower swivel assembly 80 consists of inner mandrel 83 and outer radial member, or housing, 82 which contains at least one swivel member (not shown), e.g., bearings, flex-joint, ball joint, etc. Inner mandrel 83 may include flange 84 which is in communication with riser tubular 190.

Swivel members of lower swivel assembly 80 permit movement of upper swivel assembly 50, tensioning cylinder plate 60, tensioning cylinder 70, and lower swivel assembly 80 in the direction of arrows 58, 59 and arrows 10, 12. As with upper swivel assembly 50, lower swivel assembly 80 is employed to further alleviate the potential for induced axial torque while tensioner 30 is in tension. Preferably, lower swivel assembly 80 has a range of angular motion of +/−15 degrees for alleviating the potential to induce torque and/or bending forces on tensioner 30.

Lower swivel assembly 80 may be any shape or size desired or necessary to permit radial movement of upper swivel assembly 50, tensioning cylinder plate 60, tensioning cylinder 70, and lower swivel assembly 80 in the direction of arrows 58, 59 and arrows 10, 12. As shown in FIG. 1, lower swivel assembly 80 is preferably cylindrically shaped.

As mentioned above, base 85 may also be in communication with a plurality of swivel members 76 for connecting tensioning cylinder 70 to base. Swivel members 76 alleviate the potential for tensioning cylinder 70 and rod 74 bending movement which would cause increased wear in the packing elements (not shown) in the gland seal (not shown) disposed at the interface between rod 74 and cylinder casing 73. Each swivel member 76 provides an angular motion of range of 15 degrees over 360 degrees in the direction of arrows 58, 59 and arrows 10, 12.

Referring now to FIG. 3, in one specific embodiment, tensioner 30 includes various pieces of equipment 200 disposed within area 205 (see FIGS. 1, 3 and 7) formed by tensioning cylinders 70. In the embodiment shown in FIG. 3, equipment 200 may include snubbing unit 202, spacer 206, or multiple blow-out preventers 220. Tensioner 30 shown in FIG. 3 also includes additional blow-out preventers 224 and spacer 207 disposed on extension platform 91. Therefore, as shown in FIG. 3, in this arrangement, numerous pieces of equipment 200 can be disposed placed in the riser string without increasing the length of the riser string. Moreover, tensioner 30 may be customized with desired or necessary equipment to engage in drilling, workover, or other production operations prior to be transported to the vessel or platform 150. Accordingly, the riser string, with tensioner 30 and all equipment desired or necessary may be more quickly and easily installed, thereby reducing well "downtime" and increasing productivity of the well.

Figure 8:
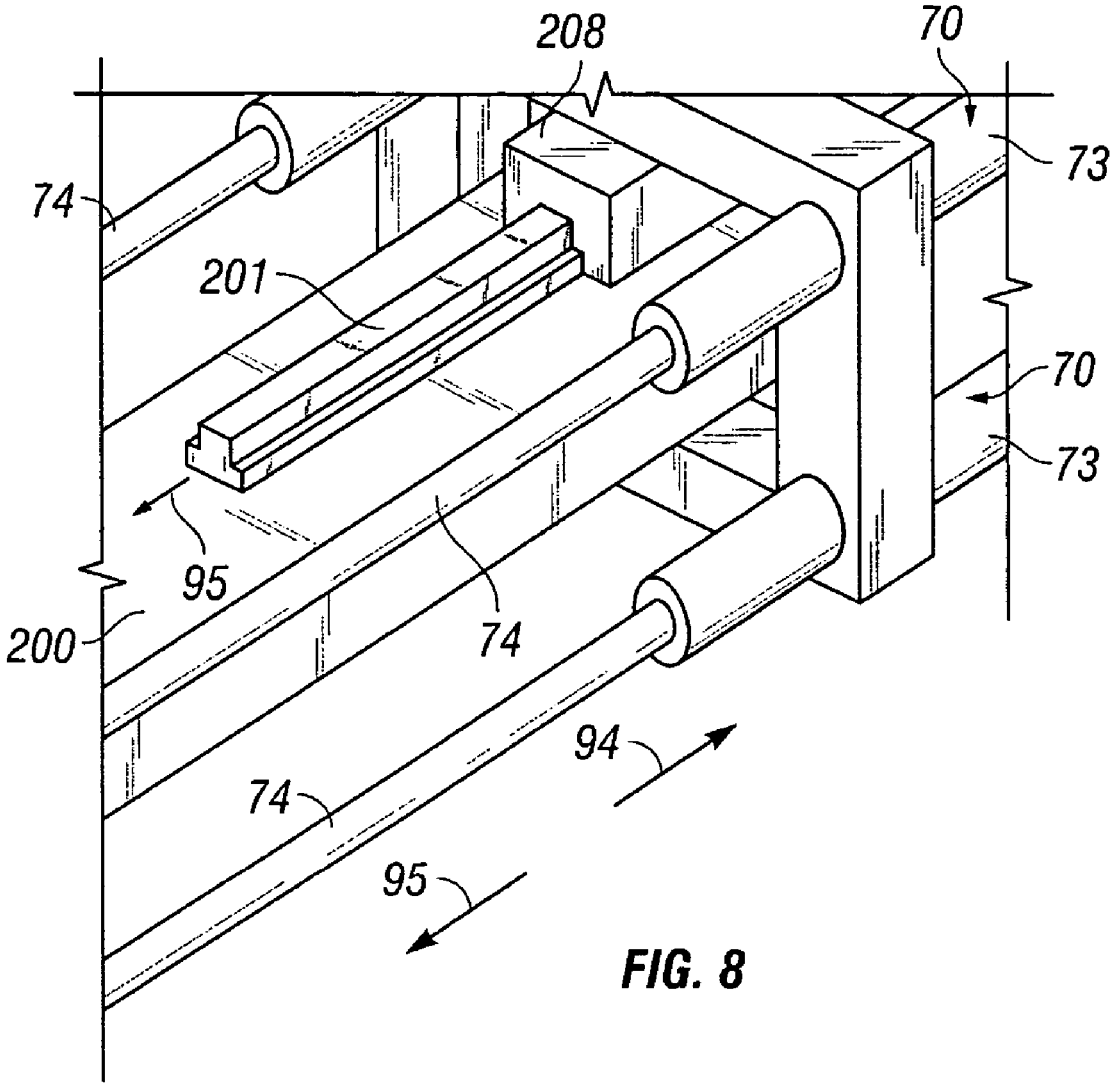
FIG. 8 is a perspective close-up view of the guide and equipment guide rail of the embodiment shown in FIG. 3.

To facilitate movement of tensioner 30 in the direction of arrows 94, 95, tensioner 30 (shown in FIG. 3 and shown in greater detail in FIG. 8) includes at least one equipment guide rail 201 and the piece of equipment 200 includes at least one guide 208. Each of the at least one equipment guide rails 201 slidably engages a corresponding guide 208 to facilitate movement of equipment 200 in the direction of arrows 94, 95. Preferably, two or more equipment guide rails 201 and two or more guides 208 are provided on tensioner 30 and equipment 200. Notwithstanding the foregoing description of equipment guide rail 201 and guide 208, it is to be understood, however, that tensioner 30 may include guide 208 and the piece of equipment 200 may include equipment guide rail 201.

In drilling applications, tensioner 30 is connected to the diverter (not shown), which is generally supported under the drilling rig floor sub-structure through any method or manner known by persons skilled in the art. In one specific embodiment, the connection between tensioner 30 and the diverter may be accomplished by means of a bolted flange, e.g., via a studded connection. In another specific embodiment, tensioner 30 is connected to the diverter by inserting mandrel interface 47 into a connector (not shown) attached to the diverter. In this embodiment, interface mandrel 46 includes latch dog profile 49 that connects to the connector via matching latch dogs which may be hydraulically, pneumatically, or manually energized. In addition, a metal to metal sealing gasket profile is preferably machined in the top of mandrel 40 to effect a pressure containing seal within the connector.

A production or a drilling riser, collectively "riser," can be run to depth with tensioner 30 using a lifting device, e.g., a crane, jack knife hoisting rig, rack and pinion elevator assembly, or other suitable lifting device. Therefore, in one embodiment, the production riser for drill step tests and other uses, or, in another embodiment, the drilling riser, can be assembled without the need for large amounts of heavy equipment, e.g., a full size derrick.

Due to the novel features of the tensioners of the present invention, tensioners may be easily installed and removed from the vessel or platform superstructure. Broadly, the method of installing tensioner 30 of the invention includes the steps of providing tensioner 30 described in greater detail above, and drilling or production facility, e.g., drilling/production vessel or platform 150, having rig floor 154 and wellhead opening 130 defining an open area 133, e.g., rotary table opening 132, through rig floor 154 providing access from rig floor 154 to the surface of the water. Tensioner 30 includes weight and size dimensions such that existing lifting devices can handle and maintain tensioner 30. During workover operations, rig floor 154 has installed a rotary table (not shown) disposed above wellhead 160 which is preferably centered within wellhead opening 130. Prior to installation of tensioner 30, the rotary table is removed from the superstructure so that tensioner 30 may be dropped through rig floor 154 until top load plate 45 is in contact with the rotary beams 120 (see FIGS. 6-7). In one specific embodiment, after removal of the rotary table, rotary beams 120 may be moved in the directions of arrows 121, 122 to increase the size of rotary table opening 132, thereby permitting larger sized tensioners 30 to be installed on the same vessel or platform 150.

Removal of tensioner 30 is easily accomplished by lifting tensioner 30 out of wellhead opening 130 in the similar manner as which tensioner 30 was installed.

In the embodiments of the tensioners 30 of the invention in which mandrel 40 is in communication with rotary table 110 (FIG. 3), the rotary table removed from the vessel or platform 150 is not required to be re-installed, thereby reducing the down-time of the well. While the foregoing method has been described with respect to inclusion of a rotary table as part of tensioner 30, it is to be understood that tensioner 30 may include one or more pieces of equipment in addition to, or in place of, rotary table 110. Moreover, while the methods of the invention may have been described, in greater detail referring to rig floor 154 of a vessel, it is to be understood that rig floor 154 may be disposed on a platform.

It is to be understood that the invention is not limited to the exact details of construction, operation, exact materials, or embodiments shown and described, as obvious modifications and equivalents will be apparent to one skilled in the art. For example, the rod end of the tensioning cylinder may be in communication with the tensioning cylinder plate. Also, the individual sub-assemblies may be manufactured separately and assembled using bolts, welding, or any other device or method known to persons of ordinary skill in the art. Moreover, the individual assemblies may be manufactured out of any material and through any method known to persons of ordinary skill in the art. Additionally, one or more manifolds may be included as part of the tensioner to facilitate controlling the pressure contained in each of the cylinder cavities. Further, the equipment disposed within the area formed by the tensioning cylinders may be any piece of equipment desired or necessary to provide the required function of production or drilling. Accordingly, while the invention has been described with respect to certain workover equipment, it is understood that any other type of equipment may be disposed within the area formed by the tensioning cylinders. Moreover, the swivel members may be a flex-joint, ball-joint, clevis and pin, shackle, or other mechanical joining or lifting device that provides angular movement. Accordingly, the invention is therefore to be limited only by the scope of the claims.

What is claimed is:

1. A tensioner comprising:

at least one top load plate;

at least one upper swivel member in communication with the at least one top load plate;

at least one cylinder plate in communication with the at least one upper swivel member;

at least one tensioning cylinder having a blind end and a rod end, the blind end being in communication with the at least one cylinder plate and the rod end being in communication with at least one rod end swivel member;

a base having a top side and a bottom side, the top side of the base being connected to the at least one rod end swivel member, at least one extension rod connected to the bottom side of the base; and at least one extension platform connected to at least one of the at least one extension rods, the extension platform being disposed below the base, thereby forming a unitary, co-linear tensioner.

2. The tensioner of claim 1, further comprising at least one piece of equipment being in communication with the top load plate.

3. The tensioner of claim 2, wherein at least one of the at least one piece of equipment includes a rotary table.

4. The tensioner of claim 3, wherein the rotary table is formed integral with the top load plate.

5. The tensioner of claim 1, wherein the tensioner includes at least two tensioning cylinders disposed along a tensioning cylinder plate thereby forming an area in between the at least two tensioning cylinders.

6. The tensioner of claim 1, wherein at least one piece of equipment is disposed on at least one of the at least one extension platforms.

7. The tensioner of claim 6, wherein the at least one piece of equipment includes at least one spacer.

8. The tensioner of claim 6, wherein the at least one piece of equipment includes at least one blowout preventer.

9. The tensioner of claim 1, wherein each of the at least one tensioning cylinders includes a tensioning cylinder casing having a length and at least one fluid control port.

10. The tensioner of claim 9, wherein each of the at least one fluid control ports is disposed along the length of each of the tensioning cylinders.

11. The tensioner of claim 9, wherein at least one of the at least one fluid control ports is disposed along the length of each of the tensioning cylinders.

12. The tensioner of claim 1, further comprising at least one lower swivel member in communication with the base.

13. A tensioner comprising:

at least one upper swivel assembly, at least one tensioning cylinder plate, at least one tensioning cylinder, a base, at least one extension rod, and at least one extension platform, the at least one tensioning cylinder being in communication with the at least one tensioning cylinder plate and connected to a top side of the base, and the at least one extension rod being connected to a bottom side of the base and each of the at least one extension platforms so that each of the at least one extension platforms is disposed below the base, wherein the at least one upper swivel assembly, the at least one tensioning cylinder plate, the at least one tensioning cylinder, the base, each of the at least one extension rods and each of the at least one extension platforms are assembled to form a unitary, co-linear tensioner.

14. The tensioner of claim 13, further comprising at least one lower swivel assembly.

15. The tensioner of claim 13, wherein the tensioner includes at least four tensioning cylinders disposed along a tensioning cylinder plate.

16. The tensioner of claim 15, wherein the at least four tensioning cylinders form an area in between the at least four tensioning cylinders.

17. The tensioner of claim 13, further comprising a top load plate and a rotary table, the rotary table being formed integral with the top load plate.

18. A method of installing at least one tensioner through a wellhead opening defining an open area size disposed along a rig floor of a drilling or production vessel or platform, the method comprising the steps of:

providing a drilling or production vessel or platform having a rig floor, the rig floor having a wellhead opening, the wellhead opening defining an open area through which the at least one tensioner is passed;

providing at least one tensioner having at least one top load plate at least one upper swivel assembly, at least one tensioning cylinder plate, at least one tensioning cylinder, a base, at least one extension rod, and at least one extension platform, the at least one tensioning cylinder being in communication with the at least one tensioning cylinder plate and connected to a top side of the base, and the at least one extension rod being connected to a bottom side of the base and each of the at least one extension platforms so that each of the at least one extension platforms is disposed below the base, wherein the at least one top load plate, the at least one upper swivel assembly, the at least one tensioning cylinder plate, the at least one tensioning cylinder, the base, each of the at least one extension rods, and each of the at least one extension platforms are assembled to form a unitary, co-linear tensioner;

lowering the at least one tensioner through the open area of the wellhead opening of the rig floor; installing the at least one tensioner by contacting the top load plate with the rig floor whereby the rig floor supports the at least one tensioner.

19. The method of claim 18, wherein the rig floor includes at least one moveable rotary table beam and the method includes the further step of moving the at least one moveable rotary table beam to increase the open area of the wellhead opening prior to lowering the at least one tensioner through the open area of the wellhead opening of the rig floor.

20. The tensioner of claim 2, wherein at least one of the at least one piece of equipment includes a snubbing unit.

21. The tensioner of claim 20, wherein the snubbing unit is formed integral with the top load plate.

22. The tensioner of claim 2, wherein at least one of the at least one piece of equipment includes a blowout preventer.

23. The tensioner of claim 22, wherein the blowout preventer is formed integral with the top load plate.

24. The tensioner of claim 13, further comprising a top load plate and a snubbing unit, the snubbing unit being formed integral with the top load plate.

25. The tensioner of claim 13, further comprising a top load plate and a blowout preventer, the blowout preventer being formed integral with the top load plate.

* * * * *